US009107785B2

(12) United States Patent
Ferrin

(10) Patent No.: US 9,107,785 B2
(45) Date of Patent: Aug. 18, 2015

(54) GURNEY ATTACHMENT FOR USE IN HELICOPTER TRANSPORT AND METHOD THEREFOR

(71) Applicant: Robert Ferrin, San Tan Valley, AZ (US)

(72) Inventor: Robert Ferrin, San Tan Valley, AZ (US)

( * ) Notice: Subject to any disclaimer, the term of this patent is extended or adjusted under 35 U.S.C. 154(b) by 29 days.

(21) Appl. No.: 13/901,850

(22) Filed: May 24, 2013

(65) Prior Publication Data

US 2014/0345045 A1 Nov. 27, 2014

(51) Int. Cl.
*A61G 3/06* (2006.01)

(52) U.S. Cl.
CPC ..... *A61G 3/061* (2013.01)

(58) Field of Classification Search
CPC ..... A61G 3/06
USPC ..... 5/625–628, 620, 81.1 R, 86.1, 81.1 HS
See application file for complete search history.

(56) References Cited

U.S. PATENT DOCUMENTS

| | | | | |
|---|---|---|---|---|
| 4,483,499 | A | 11/1984 | Fronk | |
| 4,584,989 | A * | 4/1986 | Stith | 600/18 |
| 4,843,665 | A | 7/1989 | Cockel et al. | |
| 5,135,350 | A | 8/1992 | Eelman | |
| 5,490,703 | A * | 2/1996 | Hewko | 296/19 |
| 5,740,884 | A | 4/1998 | DiMucci et al. | |
| 6,546,577 | B1 | 4/2003 | Chinn | |
| 6,681,424 | B1 | 1/2004 | Bourgraf et al. | |
| 6,895,618 | B2 | 5/2005 | Jarhling | |
| 7,140,055 | B2 | 11/2006 | Bishop et al. | |
| 7,458,117 | B2 | 12/2008 | Schaefer | |
| 8,307,474 | B2 | 11/2012 | Sandland et al. | |
| 2012/0043443 | A1 | 2/2012 | Lawless | |

OTHER PUBLICATIONS

Ergonomics in the rescue service—Ergonomic evaluation of ambulance Kluth K; Strasser H; Bonatz P University Siegen, Work Sci Ergon Div; Siegne, Germany International Journal of Industrial Ergonomics, 2006, vol. 36, No. 3 (Mar.), p. 247-256.

* cited by examiner

*Primary Examiner* — Fredrick Conley
(74) *Attorney, Agent, or Firm* — Weiss & Moy, P.C.; Jeffrey D. Moy

(57) ABSTRACT

A device for existing gurneys to allow for transfer of a litter on a helicopter onto the gurney has a raised platform. The raised platform is configured to be positioned on top of the gurney, wherein a top surface of the raised platform is approximately level with a device for transferring the litter from the helicopter to the gurney.

17 Claims, 5 Drawing Sheets

GURNEY ATTACHMENT FOR USE IN HELICOPTER TRANSPORT AND METHOD THEREFOR

TECHNICAL FIELD

The present application generally relates to a patient transport device, and more specifically, to an attachment which may be added to existing gurneys which would allow one to easily transfer a patient from a litter on a helicopter onto the gurney to prevent injuries to medical personnel transferring the patient.

BACKGROUND

When a patient is transported by a helicopter, the patient is generally placed onto a litter. The litter is then loaded onto a helicopter to transport the patient to a health care facility. Once the helicopter lands on a heliport of the healthcare facility, a gurney from the healthcare facility is bought to the helicopter. The litter, with the patient, is then transferred from the helicopter to the gurney by medical personnel.

While the gurney is adjustable in height, present gurneys are too short and do not extend up to the bottom of the door opening in the helicopter. Thus, there is generally a 1-2 feet difference between the height of the helicopter door and the top of the gurney. This height differential may cause injuries to the medical personnel transferring the patient. When unloading the litter, medical personnel may injure their hands when unloading the litter to the gurney as their hands/fingers may get caught under the litter when moving the litter to the gurney. The injuries caused by such a mishap may be as minor as a scratch and or cut to one or more fingers to as serious as a sprain or broken finger(s). Further, the height differential requires medical personnel transferring the patient to lift and lower the gurney to the litter which may cause possible shoulder, back, arm or other injuries.

Therefore, it would be desirable to provide a system and method that overcomes the above. The system and method would provide for an extension or raised platform which is placed on top of the gurney to place the top of the gurney level with the helicopter. The stretcher may then be on the same level as the gurney and slide directly onto the gurney.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with one aspect of the present application, a device for existing gurneys to allow for transfer of a litter on a helicopter onto the gurney is disclosed. The device has a raised platform. The raised platform is configured to be positioned on top of the gurney, wherein a top surface of the raised platform is approximately level with a device for transferring the litter from the helicopter to the gurney.

In accordance with another aspect of the present application, a device for existing gurneys to allow for transfer of a litter on a helicopter onto the gurney is disclosed. The device has a body member, wherein the body member is configured to be positioned on top of the gurney, wherein a top surface of the raised platform is approximately level with a device for transferring the litter from the helicopter to the gurney. At least one drawer is formed within a side surface of the body member.

In accordance with another aspect of the present application, A device for existing gurneys to allow for transfer of a litter on a helicopter onto the gurney is disclosed. The device has a body member, wherein the body member is configured to be positioned on top of the gurney, wherein a top surface of the raised platform is approximately level with a device for transferring the litter from the helicopter to the gurney. An attachment device is provided for coupling the raised platform to the gurney. At least one drawer is formed within a side surface of the body member. A movable shelf is attached to the body member, wherein a top surface of the movable shelf is approximately planer with a top surface of the body member when the movable shelf is in a retracted position. The movable shelf has a planer member. A pair of sliding hinges is coupled to the planer member.

The features, functions, and advantages may be achieved independently in various embodiments of the disclosure or may be combined in vet other embodiments.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE APPLICATION

The description set forth below in connection with the appended drawings is intended as a description of presently preferred embodiments of the application and is not intended to represent the only forms in which the present application can be constructed and/or utilized. The description sets forth the functions and the sequence of steps for constructing and operating the application in connection with the illustrated embodiments. It is to be understood, however, that the same or equivalent functions and sequences can be accomplished by different embodiments that are also intended to be encompassed within the spirit and scope of this application.

The present invention relates to an extension or raised platform which is placed on top of the gurney. The extension or raised platform allows the top of the gurney to be level with the bottom of an opening in a helicopter door. This may allow a litter to be on the same level as the gurney thereby allowing the litter to be slide directly onto the gurney thereby preventing injuries to medical personnel transferring the litter.

Figure 1:
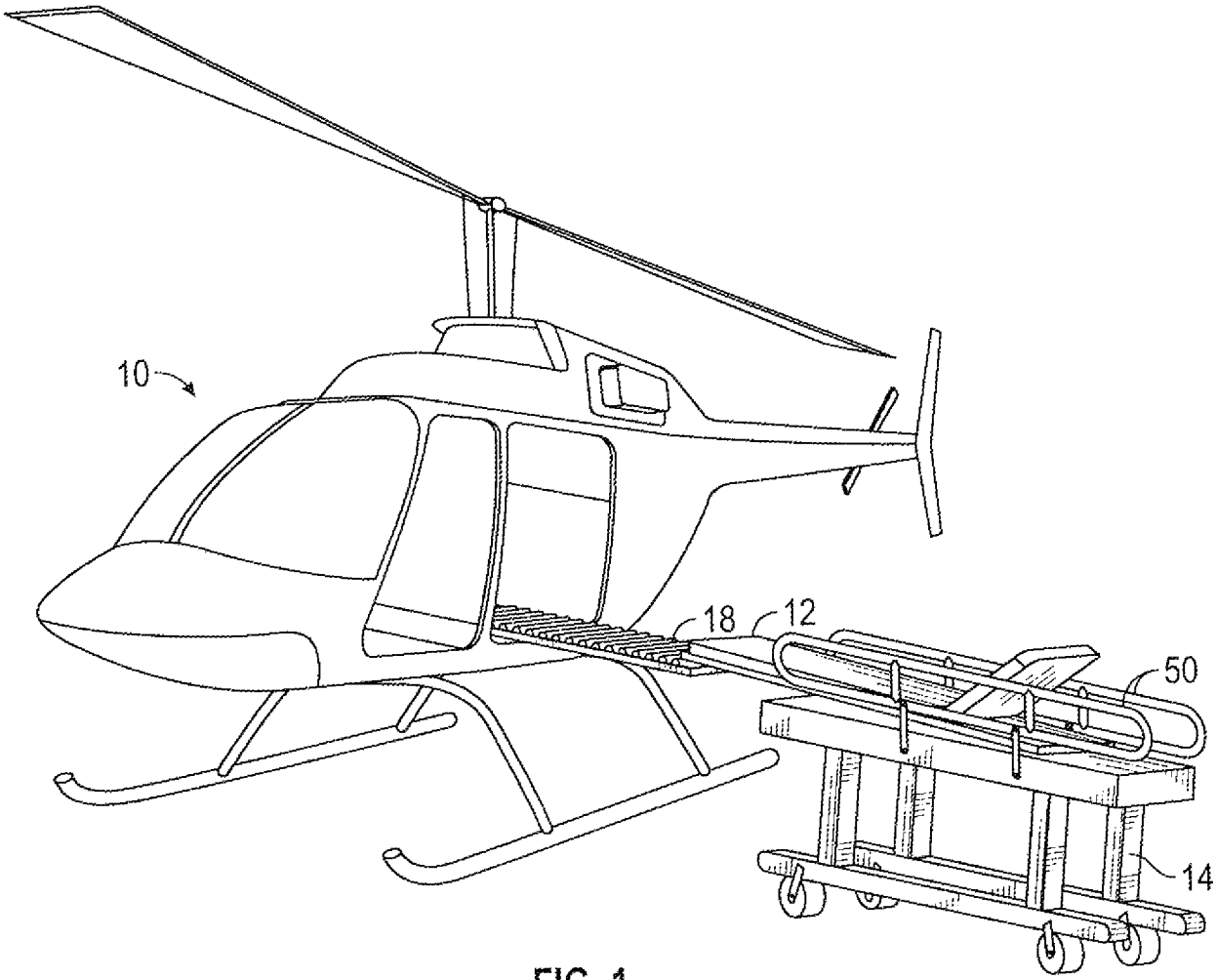
FIG. 1 is a perspective view showing a height differential between an existing gurney and a bottom of an opening in a helicopter transport.
Figure 2:
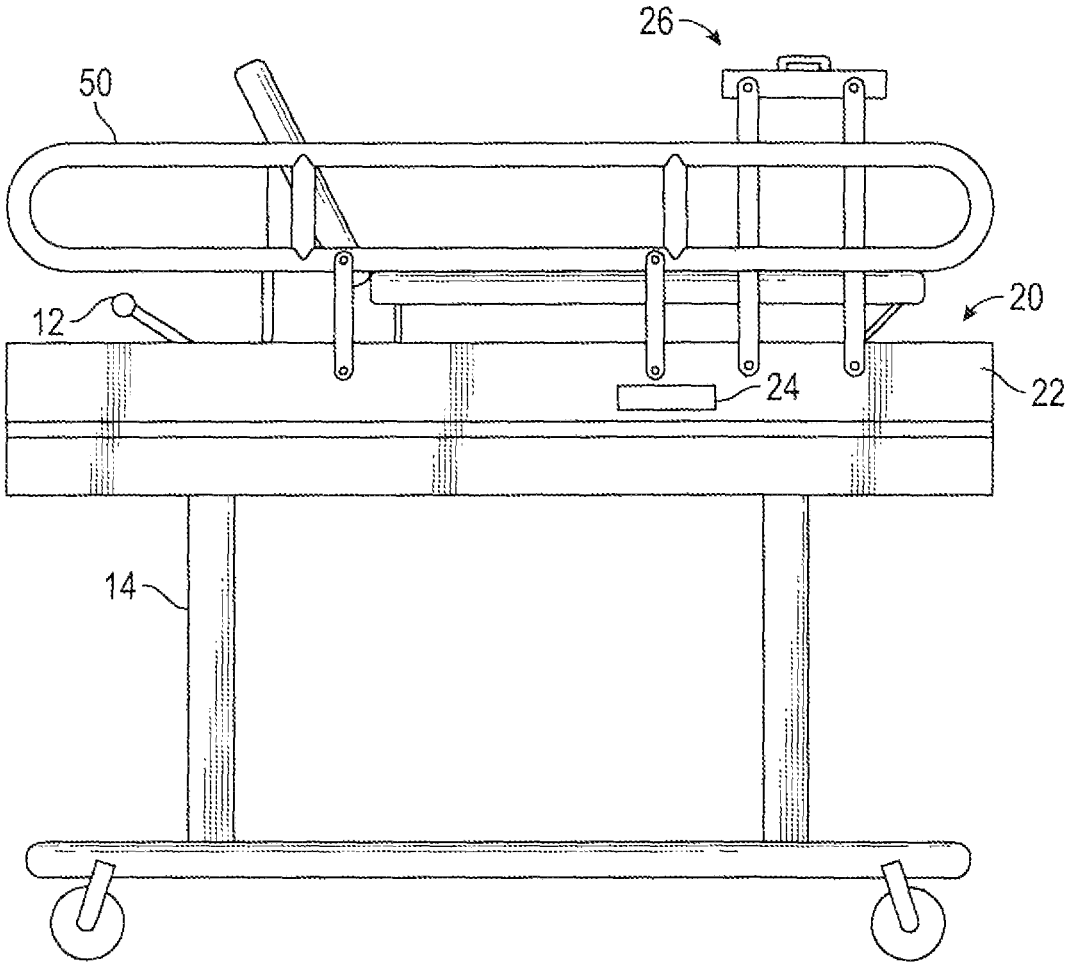
FIG. 2 is a side view showing a litter on a gurney having the gurney attachment of the present invention.
Figure 3:
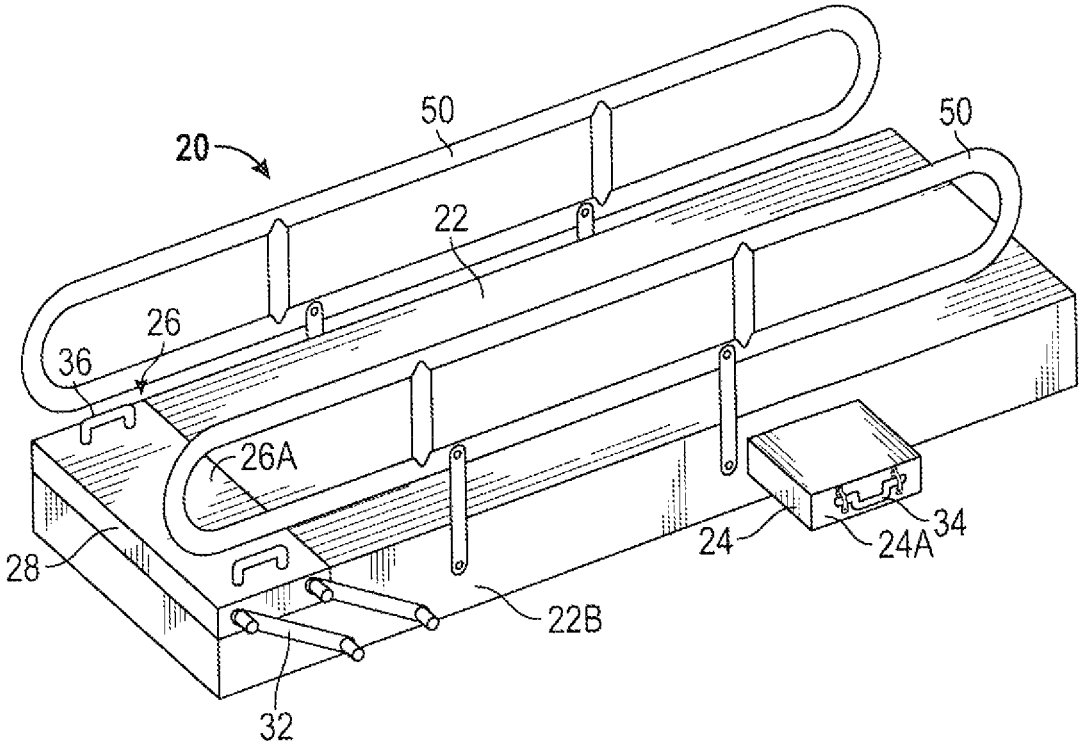
FIG. 3 is a perspective view of the gurney attachment having a side drawer in an open position.
Figure 4:
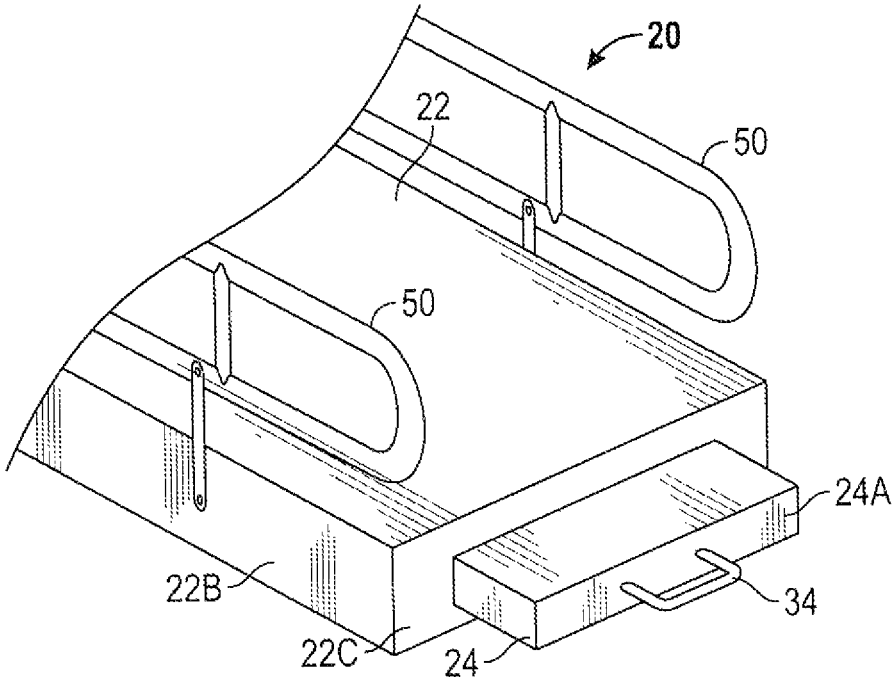
FIG. 4 is a perspective end view of the gurney attachment showing a drawer in an open position.
Figure 5:
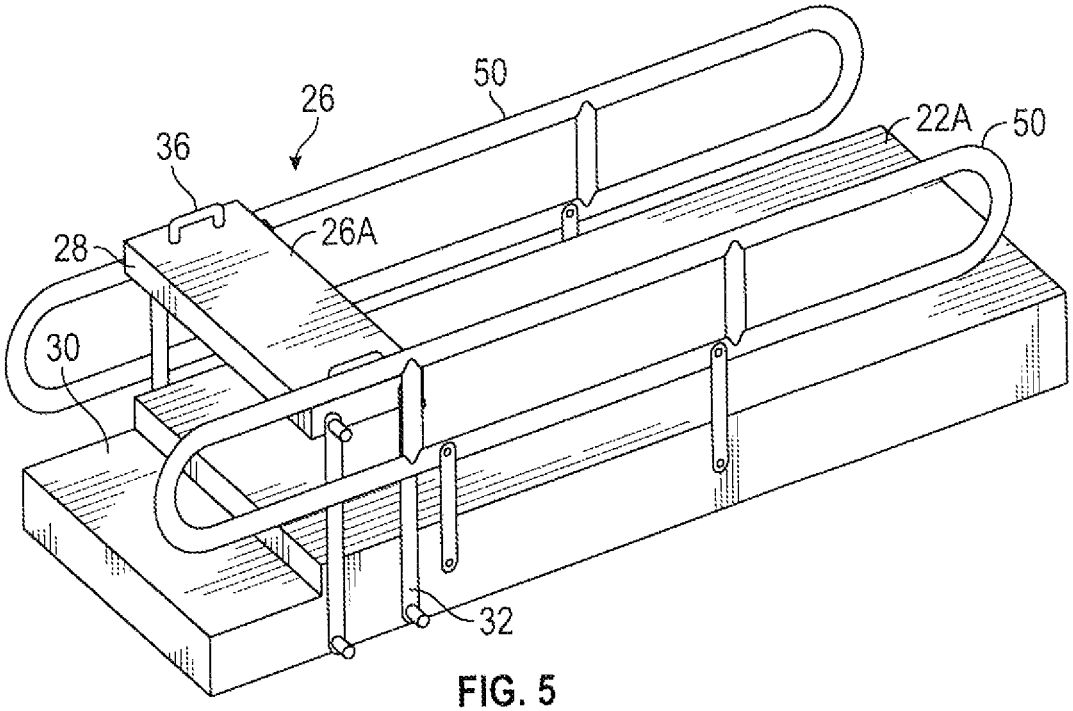
FIG. 5 is a perspective view of the gurney attachment having a table in an extended position.

Referring to FIG. 1, when a patient is transported by a helicopter 10, the patient is generally placed onto a litter The litter 12 is then loaded onto a helicopter 10 to transport the patient to a health care facility. Once the helicopter 10 lands on a heliport of the healthcare facility, a gurney 14 from the healthcare facility is bought to the helicopter 10. The litter, with the patient, is then transferred from the helicopter 10 to the gurney 14 by medical personnel.

While the gurney 14 is adjustable in height, present gurneys 14 are too short and do not extend up to the bottom of a rolling platform 16 at the door opening in the helicopter 10. Thus, there is generally a 1-2 feet difference between the height of the rolling platform 16 at the door opening in the helicopter 10 and the top of the gurney 14. This height differential may cause injuries to the medical personnel transferring the patient. When unloading the litter 12, medical personnel may injure their hands when unloading the litter to the gurney 14 as their hands/fingers may get caught under the litter 12 when moving the litter 12 to the gurney 14.

Referring now to FIGS. 2-7, a gurney extension 20 is shown. The gurney attachment 20 is basically a raised platform which is placed on top of the gurney 14. The raised platform allows the top of the gurney 14 to be level with the bottom of the rolling platform 16 (FIG. 1) at the door opening in the helicopter 10 (FIG. 1). This may allow a litter 12 to be on the same level as the gurney 14 thereby allowing the litter 12 to be slide directly onto the gurney 14 thereby preventing injuries to medical personnel transferring the litter 12.

The gurney extension 20 is comprised of a body section 22. The body section 22 may come in various shapes. In accordance with one embodiment, the body section 22 may be a rectangular cuboid. The body section 22 is generally sized and shaped to be positioned on a top surface of a gurney 14. The body section 22 may be solid or hollow. In general, the body section 22 maybe formed of a material to support the weight of a litter and patient on the litter 12 which may be placed on top of the body section 22. In accordance with one embodiment, the body section 22 may be comprised of a hardened plastic, carbonfiber, aluminum, or the like.

The body section 22 may have one or more drawers 24 formed within the body section 22. While the Figures show a drawer 24 formed on a side surface 22B of the body section 12 and a front surface 22C of the body section 22, a drawer 24 may be located on other surfaces and or sections of the body section 12 without departing from the spirit and scope of the present invention. Also, while one drawer 24 is shown on the side surface 22B, multiple drawers 24 may also be formed on the side surface 22B.

The drawers 24 may be designed to slide in so that a front surface 24A of the drawer 24 is flat against the body section 22. The drawers 24 may be used to hold medical supplies that may be needed during transport of a patient when using the gurney extension 20. A handle 34 may be attached to the front surface 24A of the drawer 24. The handle 34 may be used to open and close the each drawer 24. The handle 34 may also be sued to move the gurney extension 20.

The body section 22 may have a retractable shelf 26 attached thereto. In a retracted position, a top surface 26A of the retractable shelf 26 may be flush with a top surface 22A of the body section 22. The retractable shelf 26 may be comprised of a planer member 28. The planer member 28 may sit within a channel 30 formed within the body section 22 when the retractable shelf 26 is in a retracted position. A pair of sliding hinges 32 may be coupled to the planer member 28. The pair of sliding hinges 32 maybe used to allow the planer member 28 to rotate upward and lock in an extended position so that the planer member 28 may be used as a shelf to position equipment that may be needed by medical personnel. Presently, large medical equipment is often placed on the gurney 14. Thus, the retractable shelf 26, may allow medical personnel to place these items on the retractable shelf 26 so as to not disrupt the patient. One or more handles 36 may be attached to the retractable shelf 26. The handle 36 maybe used to raise and lower the retractable shelf 26.

Rails 50 may be coupled to the body section 22. The rails 50 may be coupled to allow one to raise and lower the rails when required.

Figure 6:
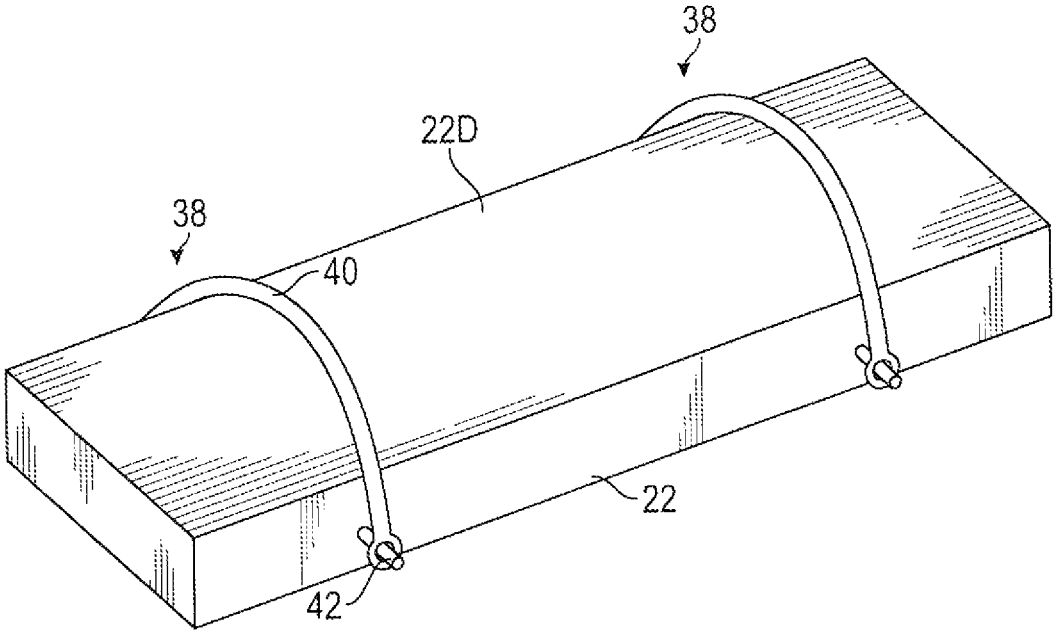
FIG. 6 is a perspective bottom view showing one embodiment of an attachment device used in the gurney attachment of the present invention.

An attachment device 38 may be formed on the body section 22. The attachment device 38 may be used to secure the gurney extension 20 to the gurney 14. FIG. 6 shows one embodiment of the attachment device 38. In this embodiment, the attachment device 38 may be one or more straps 40. The straps 40 may be coupled to opposing side surfaces 22B on the body section 22. An attachment device 42 may be used to secure the straps 40 to the opposing side surfaces 22C. The attachment device 42 may be removable devices such as a screws or the like. Alternatively, the attachment device 42 may be permanently attached to the side surfaces 22B. A buckle or other item maybe formed on each strap 40 to allow one to attach and remove the gurney extension 20 to the gurney 14.

Figure 7:
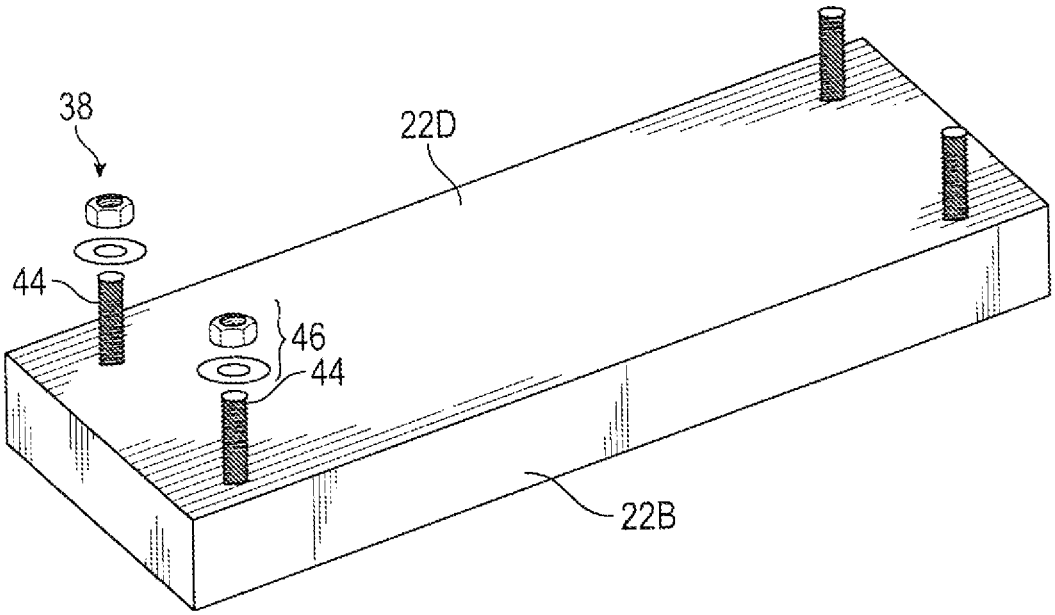
FIG. 7 is a perspective bottom view showing another embodiment of an attachment device used in the gurney attachment of the present invention.

Referring to FIG. 7, another embodiment of the attachment device 38 is shown. In this embodiment, the attachment device 38 may be formed of a plurality of threaded rod members 44 attached to a bottom surface 22D of the body section 22. The rod members 44 may be placed through openings formed in the gurney 14. A nut/washer assembly 46 or other device may be attached to the rod member 44 to secure the gurney extension 20 to the gurney 14.

While embodiments of the disclosure have been described in terms of various specific embodiments, those skilled in the art will recognize that the embodiments of the disclosure may be practiced with modifications within the spirit and scope of the claims. For example, an outlet may be formed within the body section 22. The outlet may be attached to a power source such as a rechargeable battery. The outlet may be used to power different medical equipment that may be used during transport.

What is claimed is:

1. A device for existing gurneys to allow for transfer of a litter on a helicopter onto the gurney comprising:

a raised platform removably coupled on top of the gurney, wherein a top surface of the raised platform when on the gurney is approximately level with a device for transferring the litter from the helicopter to the gurney;

a channel formed on the top surface of the raise platform; and a retractable shelf coupled to the raised platform, wherein a top surface of the retractable shelf resides within the channel and is flush with a top surface of the raised platform in a retracted position and rises above the top surface of the raised platform in an extended position.

2. The device of claim 1, wherein the raised platform comprises:

a body member; and at least one drawer formed within a side surface of the body member.

3. The device of claim 1, wherein the retractable shelf comprises:

a planer member; and a pair of sliding hinges coupled to the planer member.

4. The device of claim 3, wherein the retractable shelf further comprises at least one handle coupled to the planer member.

5. The device of claim 1, wherein the retractable shelf comprises:

a planer member; and a pair of sliding hinges coupled to the planer member.

6. The device of claim 5, wherein the retractable shelf further comprises at least one handle coupled to the planer member.

7. The device of claim 1, further comprising an attachment device for coupling the raised platform to the gurney.

8. The device of claim 7, wherein the attachment device comprises at least one strap.

9. The device of claim 7, wherein the attachment device comprises:

a plurality of threaded rod members extend from a bottom surface of the raised platform; and a plurality of nuts coupled to the threaded rod members.

10. A device for existing gurneys to allow for transfer of a litter on a helicopter onto the gurney comprising:

a body member removably coupled to a top of the gurney, wherein a top surface of the raised platform when on the gurney is approximately level with a device for transferring the litter from the helicopter to the gurney;

a channel formed on the top surface of the raise platform;

a retractable shelf coupled to the raised platform, wherein a top surface of the retractable shelf resides within the channel and is flush with a top surface of the raised platform in a retracted position and rises above the top surface of the raised platform in an extended position; and at least one drawer formed within a side surface of the body member.

11. The device of claim 10, wherein the retractable shelf comprises:

a planer member; and a pair of sliding hinges coupled to the planer member.

12. The device of claim 11, wherein the retractable shelf further comprises at least one handle coupled to the planer member.

13. The device of claim 10, further comprising an attachment device for coupling the raised platform to the gurney.

14. The device of claim 13, wherein the attachment device comprises at least one strap.

15. The device of claim 13, wherein the attachment device comprises:

a plurality of threaded rod members extend from a bottom surface of the raised platform; and a plurality of nuts coupled to the threaded rod members.

16. The device of claim 13, wherein the attachment device comprises at least one strap.

17. A device for existing gurneys to allow for transfer of a litter on a helicopter onto the gurney comprising:

a body member, wherein the body member is configured to be positioned on top of the gurney, wherein a top surface of the raised platform is approximately level with a device for transferring the litter from the helicopter to the gurney;

an attachment device for coupling the raised platform to the gurney;

at least one drawer formed within a side surface of the body member; and a movable shelf attached to the body member, wherein a top surface of the movable shelf is approximately planer with a top surface of the body member when the movable shelf is in a retracted position, wherein the movable shelf comprises:

a planer member; and a pair of sliding hinges coupled to the planer member.

* * * * *